US010774496B2

(12) United States Patent
Whiteley

(10) Patent No.: US 10,774,496 B2
(45) Date of Patent: Sep. 15, 2020

(54) COVER

(71) Applicant: Oxford Plastic Systems Limited, Oxfordshire (GB)

(72) Inventor: Christopher James Whiteley, Oxfordshire (GB)

(73) Assignee: Oxford Plastic Systems Limited, Oxfordshire (GB)

( * ) Notice: Subject to any disclaimer, the term of this patent is extended or adjusted under 35 U.S.C. 154(b) by 0 days.

(21) Appl. No.: 16/604,816

(22) PCT Filed: Apr. 13, 2018

(86) PCT No.: PCT/GB2018/050983
§ 371 (c)(1),
(2) Date: Oct. 11, 2019

(87) PCT Pub. No.: WO2018/189552
PCT Pub. Date: Oct. 18, 2018

(65) Prior Publication Data

US 2020/0080271 A1 Mar. 12, 2020

(30) Foreign Application Priority Data

Apr. 13, 2017 (GB) ..... 1705953.6

(51) Int. Cl.
*E02D 17/10* (2006.01)

(52) U.S. Cl.
CPC ..... *E02D 17/10* (2013.01)

(58) Field of Classification Search
CPC ..... E02D 17/10
USPC ..... 14/69.5; 404/2–6, 25, 26, 34–45
See application file for complete search history.

(56) References Cited

U.S. PATENT DOCUMENTS 4,819,910 A * 4/1989 Johnston ..... B60T 3/00 254/88
6,718,588 B1 * 4/2004 Frederiksen ..... B65G 69/30 14/69.5
6,752,381 B2 * 6/2004 Colak ..... B60T 3/00 254/88

(Continued)

FOREIGN PATENT DOCUMENTS

CA 2 796 153 A1 5/2014
WO WO 01/21898 A1 3/2001
WO WO 2015/006855 A1 1/2015

OTHER PUBLICATIONS

Search Report in counterpart United Kingdom patent application No. GB1705953.6, dated Aug. 31, 2017.

(Continued)

*Primary Examiner* — Raymond W Addie
(74) *Attorney, Agent, or Firm* — Potter Anderson and Corroon LLP

(57) ABSTRACT

A cover comprises main section 12 provided with link means to allow linking of the cover to an adjacent cover, wherein the main section 12 is shaped to include opposing side walls 18 and defines a reinforced plastics material central region 22 in which elongate reinforcement members 26 are provided extending within the side walls 18, and end regions 24 located to opposite ends of and integrally formed with the central region 22, the elongate reinforcement members 26 provided in the side walls 18 stopping short of the end regions 24, and wherein the link means are provided at the end regions 24.

16 Claims, 3 Drawing Sheets

(56) References Cited

U.S. PATENT DOCUMENTS 6,993,801 B2 * 2/2006 Marko ..... A63C 19/10 14/69.5
7,003,836 B2 * 2/2006 Berg ..... B66F 7/243 14/69.5
7,025,530 B2 * 4/2006 Beamish ..... E01C 9/08 404/35
7,104,524 B1 * 9/2006 Hidding ..... B66F 7/243 14/69.5
7,131,161 B2 * 11/2006 Lee ..... E01D 19/125 14/73
7,300,224 B2 * 11/2007 Slater ..... E01C 9/086 404/36
7,544,010 B2 * 6/2009 Restrepo ..... E01C 9/08 404/21
7,674,066 B2 * 3/2010 Wehmeyer ..... A61H 3/066 404/19
7,980,532 B2 * 7/2011 Wickwire ..... B66F 7/243 254/88
8,061,929 B2 * 11/2011 Dagesse ..... E01C 9/086 404/34
8,075,221 B2 * 12/2011 MacKenzie ..... E04D 11/00 264/299
8,282,311 B2 * 10/2012 Chow ..... B29C 45/0001 404/42
8,336,146 B1 * 12/2012 Berbash ..... H05B 3/34 14/69.5
8,382,393 B1 * 2/2013 Phillips ..... E01C 9/086 404/34
8,734,049 B1 * 5/2014 Stiles ..... E01C 9/004 404/37
8,807,865 B1 * 8/2014 Modrono ..... E01C 13/065 404/27
2013/0047351 A1 * 2/2013 Breault ..... E02D 17/10 14/24

OTHER PUBLICATIONS

International Search Report and Written Opinion in counterpart international application No. PCT/GB2018/050983, dated Jun. 28, 2018.

* cited by examiner 14
16
12
30
38
10
18
22
24
28
36
34
20

COVER

This invention relates to a cover intended for use in covering a trench or the like formed in a road surface or footpath surface to allow the continued passage of vehicles or pedestrians along the road or footpath surface.

The use of covers in covering trenches or the like formed in road surfaces is well known. Traditionally, the covers have taken the form of steel sheets positioned over trenches and anchored to the road surface using suitable pins, in use. Whilst such covers function adequately, they have the disadvantage that the covers are relatively heavy and so are inconvenient to handle and transport, for example requiring the use of lifting equipment to position the covers over the trench. Clearly, this is inconvenient. Furthermore, as vehicles ride up onto and pass over such covers a significant level of noise is typically generated.

An alternative form of cover takes the form of a metal reinforced moulded plastics panel, often formed with rubber or rubber like material flexible end sections. Such covers are of lighter weight than the traditional metallic covers and so are easier to handle and transport. Furthermore, the design of the covers and choice of materials used can result is the generation of less noise as vehicles pass over the covers.

Where a number of such covers are arranged side-by-side to cover a trench or the like, it is desirable to be able to link the covers to one another to avoid the formation of gaps therebetween and enhance the stability of the covers. Where reinforced moulded plastics material covers of the type outlined hereinbefore are used, linking of adjacent covers has been achieved by providing linking arrangements comprising interengaging projections receivable within sockets provided in the covers. The presence of the metal reinforcing members in the covers has typically meant that the fitting of the linking arrangements has had to be undertaken after moulding of the cover, and requires the formation of openings in the side walls of the cover above the positions of the reinforcing members, which cannot conveniently be moulded into the cover. As a consequence, manufacture of the cover is undesirably complex.

It is an object of the invention to provide a cover in which at least some of the disadvantages associated with known covers are overcome or are of reduced effect.

According to the present invention there is provided a cover comprising main section provided with link means to allow linking of the cover to an adjacent cover, wherein the main section is shaped to include opposing side walls and defines a reinforced plastics material central region in which elongate reinforcement members are provided extending within the side walls, and end regions located to opposite ends of and integrally formed with the central region, the elongate reinforcement members provided in the side walls stopping short of the end regions, and wherein the link means are provided at the end regions.

It will be appreciated that as the link means are provided at the end regions into which the reinforcement members do not extend, the reinforcement members do not impede the installation or formation of the link means.

Conveniently, the side walls are formed with recesses opening to the underside of the cover, the recesses being located in the end regions. Recesses of this type are relatively easy to mould into the main section, and so the manufacturing process used in the formation of the cover may be simplified compared to arrangements in which openings have to be machined into the side walls of the main section after moulding thereof.

The link means conveniently comprise a connector plate fitted to the main section and projecting from one of the recesses thereof, and a connector pin fitted to the main section adjacent another of the recesses thereof. In use, the connector pin of one cover is received within an opening provided in the connector plate of an adjacent cover to link the covers to one another. The underside of the recess with which the connector pin is associated is preferably closed by a cover plate, the recess and cover plate together defining an opening into which the connector plate of the adjacent cover is fitted for cooperation with the connector pin. In such an arrangement, separation of the covers simply by lifting one of the covers relative to the adjacent cover is resisted.

The connector plate is preferably arranged such that a part thereof in which the opening is provided is angled upwardly, in use. Conveniently, this is achieved by forming the connector plate in such a manner as to include a mounting part secured, in use, to the main section, and an upwardly angled part in which the opening is formed.

The cover preferably further comprises additional reinforcement members, the reinforcement members and additional reinforcement members together forming a grid-like arrangement. The main section preferably defines a series of downwardly depending ribs, the reinforcement members and additional reinforcement members being located within respective ones of the ribs.

Flexible end ramps are preferably fitted to the end sections.

The main section is preferably provided with an opening whereby a probe associated with a gas sensor can be introduced into a trench over which the cover extends to allow tests to be undertaken without first removing the cover from the trench.

A retainer arrangement may be provided to resist longitudinal movement of the cover, in use. The retainer arrangement conveniently comprises a housing with which a plurality of moveable pins are associated, the pins being movable under the action of gravity between raised and lowered positions, the pins projecting from the underside of the main section when in their lowered positions. Preferably, the main section is formed with mounting formations to allow the housing to be secured thereto such that the housing extends in a substantially horizontal orientation, in use. Such an arrangement is advantageous in that even where the profile of the main section is curved along its length, the same length pins may be used throughout the retainer arrangement.

The invention will further be described, by way of example, with reference to the accompanying drawings, in which.

Figures 1, 2, 3:
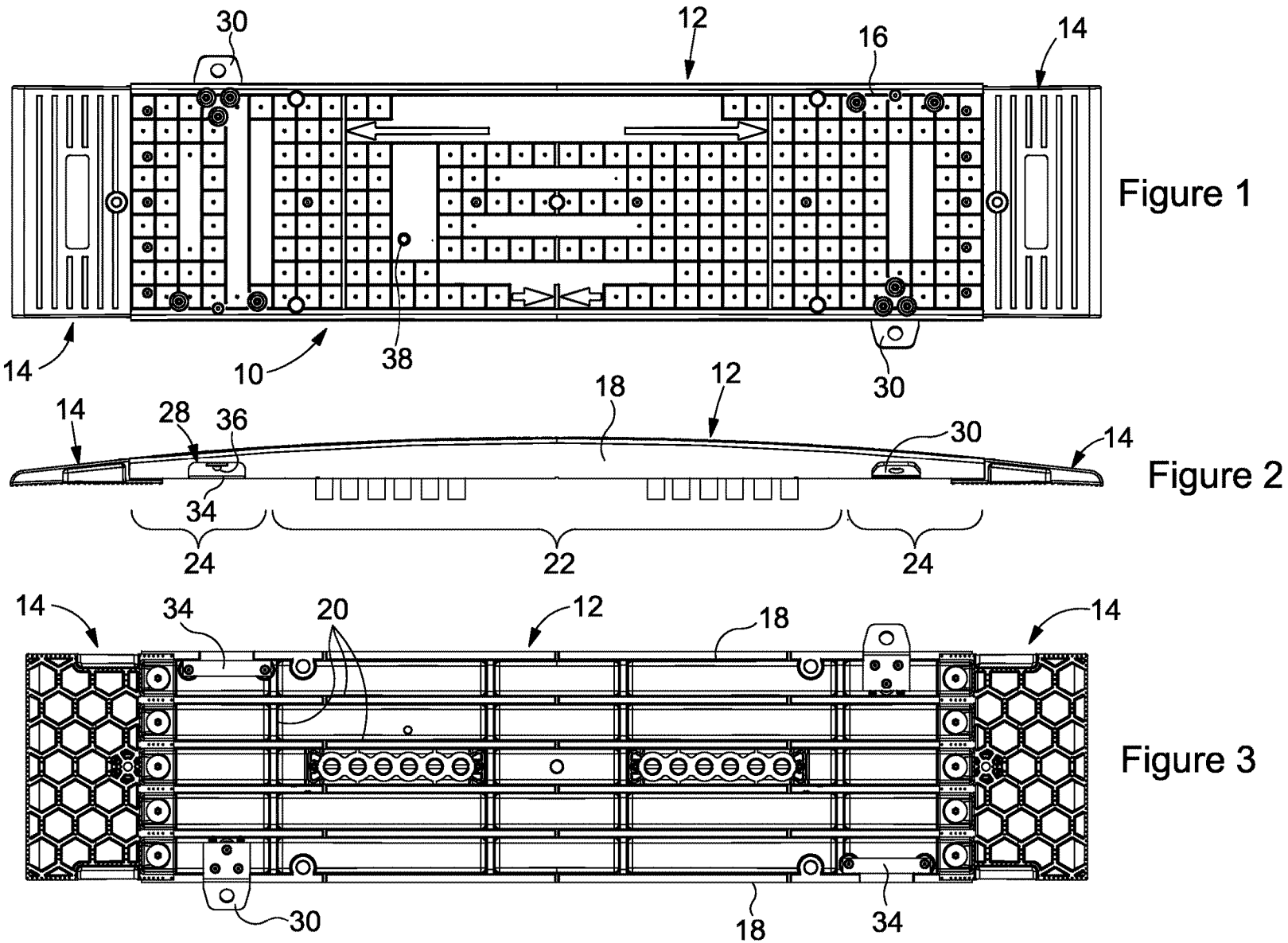
FIG. 1 is a plan view of a cover in accordance with an embodiment of the invention.
FIG. 2 is a side view of the cover of FIG. 1.
FIG. 3 is a view of the cover from beneath.
Figure 4:
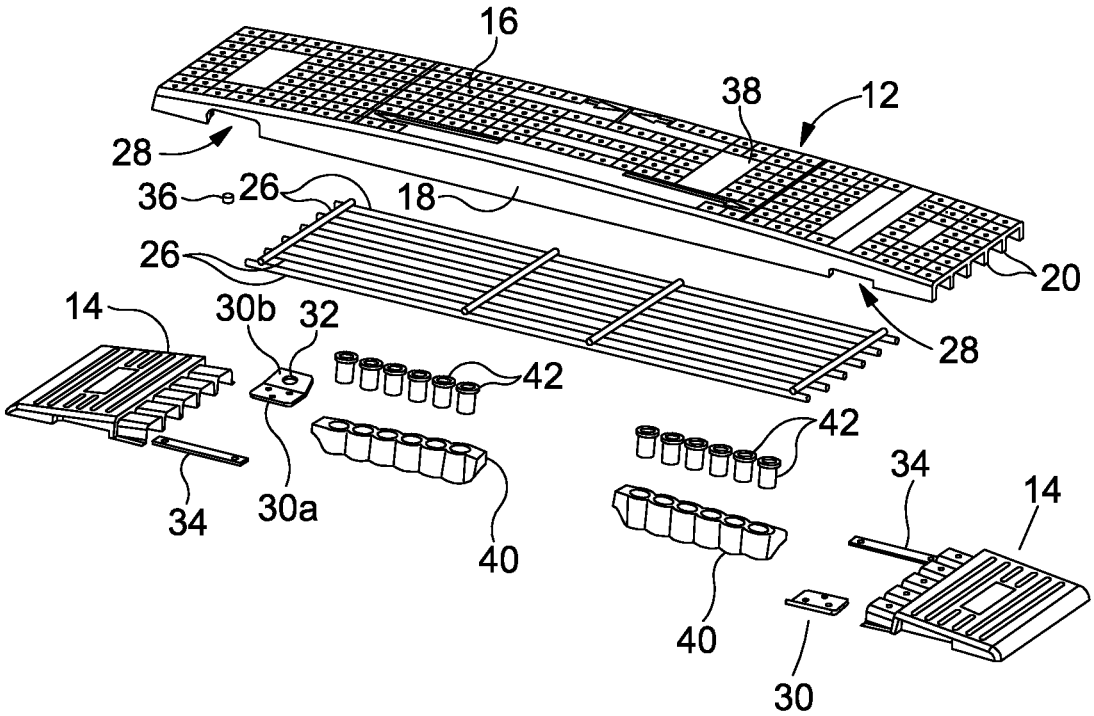
FIG. 4 is an exploded view illustrating the cover.

FIGS. 7*a* to 7*h* illustrate alternative designs of link means that may be used with the cover of FIGS. 1 to 6.

Referring to FIGS. 1 to 6 of the accompanying drawings, a cover 10 is illustrated that is intended for use, in conjunction with other similar covers, in covering a trench, opening or cavity or the like formed in a road surface or footpath surface to allow the continued use of the road or footpath by vehicles or pedestrians. The primary purpose of the cover 10 is in covering trenches formed in road surface to allow vehicles to pass over the trench. Accordingly, the cover 10 is designed to be of sufficient strength to carry vehicles over the trench.

The cover 10 is comprises a main section 12 to the ends of which are fitted end ramps 14. The main section 12 is of moulded plastics material form shaped to define an upper surface 16 and integral side walls 18. The underside of the main section 12 is formed with a series of ribs 20, some of which extend along the length of the main section 12, and some of which extend across the width of the main section 12.

The main section 12 defines a central, metal reinforced region 22, and integral end regions 24 located to opposite ends of the central region 22. In the central region 22, the side walls 18 and ribs 20 each contain respective elongate reinforcing members 26, each of which takes the form of a length of steel rod or bar. The rods or bars are conveniently welded or otherwise secured to one another in a grid-like configuration before being introduced into a mould and having the plastics material of the main section over moulded onto the reinforcing members 26. It will be appreciated, however, that this represents just one technique by which the main section 12 may be formed, and that other techniques may be used without departing from the scope of the invention.

The elongate reinforcing members 26 located within the side walls 18 stop short of the end regions 24. Likewise, the reinforcing members 26 located within the ribs 20 stop short of the end regions 24, and so the end regions 24 are not of metal reinforced form. However, it will be appreciated that arrangements are possible within the scope of the invention in which the reinforcing members 26 located within the ribs 20 (but not those located within the side walls 18) extend into the end regions 24.

The parts of the sides walls 18 located in the end regions 24 are formed with recesses 28 which open to the underside of the cover. The recesses 28 could be machined into the side walls 18 after completion of the moulding process, but are conveniently formed as part of the moulding operation, the mould being shaped in such a manner as to result in the formation of the recesses 28.

One of the recesses 28 located on each side of the cover 10 has a connector plate 30 associated therewith, the connector plate 30 extending through the recess 28 and including a mounting part 30*a* located beneath and bolted to (or otherwise secured to) the underside of the main section 12. The connector plate 30 further includes a projecting part 30*b*, angled upwardly relative to the plane of the mounting part 30*a* and provided with an opening 32.

The other of the recesses 28 located on each side of the cover 10 has a cover plate 34 mounted adjacent thereto so as to define a closed opening through which a connector pin 36 mounted to the underside of the main section 12 can be accessed.

Figure 5:
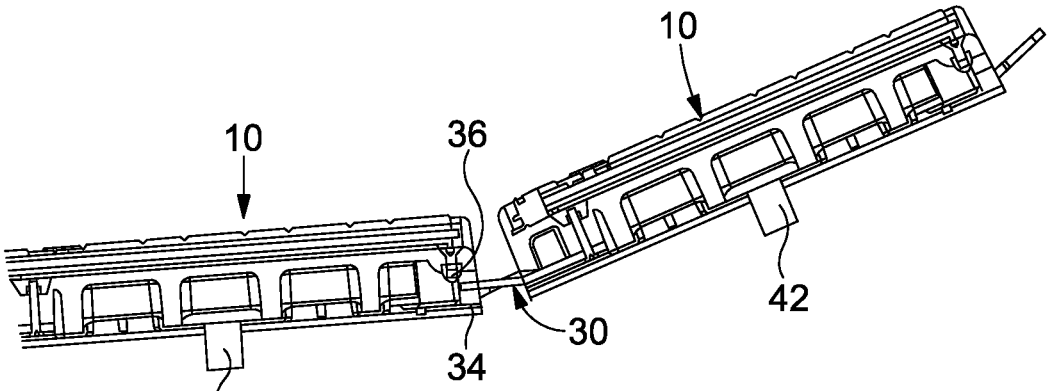
FIG. 5 is a sectional view illustrating the linking of adjacent covers.
Figure 6:
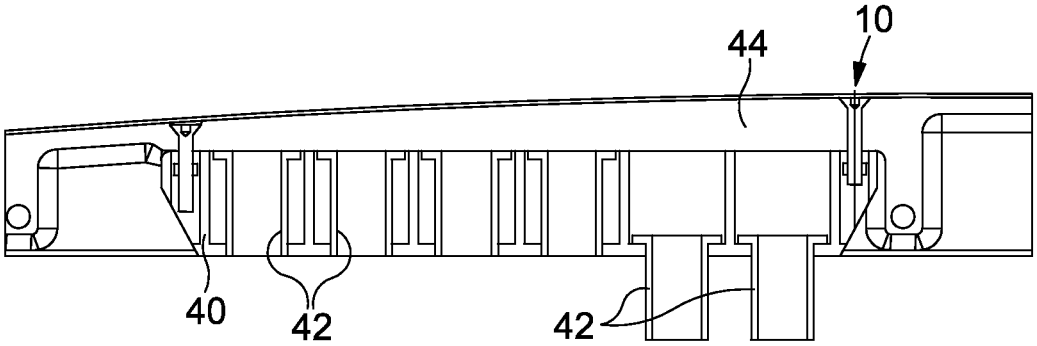
FIG. 6 is a view to an enlarged scale illustrating part of the cover.

The connector plate 30 and connector pin 36 together serve as link means whereby adjacent covers 10 can be connected or linked to one another. To link adjacent covers 10 to one another, as shown in FIG. 5, one of the covers 10 is laid in the desired position and the other is held in an angled configuration to allow the connector plates 30 to be partially inserted into the respective openings defined between the recesses 28 and cover plates 34 to align the openings 32 with the respective connector pins 36. The angled one of the covers 10 is then laid down with the result that the connector pins 36 become located within the openings 32, linking the adjacent covers 10 to one another. It will be appreciated that the presence of the cover plates 34 resists lifting of one of the covers 10 relative to the other. It will be appreciated that in this manner, a number of covers 10 can be linked to one another to form an assembly of sufficient width to cover the full length of a trench formed in a road (or other) surface.

The end ramps 14 are conveniently of a flexible rubber like material which flexes to accommodate bumps, dips or other non-uniformities in the road surface. The ramps 14 reduce noise generated as vehicles ride onto and leave the covers 10 and the nature of the materials used in the cover 10 serve to further reduce noise generation and reverberation in use.

The main section 12 is conveniently formed with one or more openings 38 through which a probe of a gas detector can be inserted, with the cover 10 in position over a trench, to allow gas measurements or tests to be undertaken without the need to first remove the cover 10.

It is desired to provide a means whereby movement of the cover 10 relative to the road surface is resisted to reduce the risk of the cover 10 moving to a position in which it is unstable or unable to safely bear the weight of vehicles or pedestrians passing over the cover 10. Conveniently, the retainer means takes the form of a housing 40 secured to the underside of the main section 12, the housing 40 having a series of pins 42 associated therewith. Each pin 42 is held captive to the housing 40 and is movable under the action of gravity between a raised position and a lowered position. In use, prior to lowering the cover into position over a trench, all of the pins 42 will adopt their extended, lowered positions, extending beneath the level of the lower edges of the side walls 18. As the cover 10 is lowered into position, the ones of the pins 42 located above the road surface to each side of the trench will be pushed into the housing 40, the remaining pins 42 remaining in their lowered positions. It will be appreciated that the pins 42 in their lowered positions may bear against the side walls of the trench, upon movement of the cover 10 relative to the road surface, limiting or resisting further movement.

The pins 42 are all of the same length, and in order to function properly, the housing 40 is preferably arranged horizontally, in use. In order to achieve this despite the curved profile of the cover 10 as illustrated, the underside of the main section 12 is conveniently provided with formations 44 upon which the housing 40 is located to hold the housing 40 in a substantially horizontal configuration, in use.

It will be appreciated that the cover 10 is advantageous in that the installation of the link means does not require the formation of openings in the side walls of the main section after completion of the moulding thereof, instead the link means being fitted in recesses that can be formed as part of the moulding process. The formation of the recesses as part of the moulding process is permitted through arranging for the reinforcing members to stop short of the end sections. In known cover designs, the presence of reinforcing members in these locations prevents the formation of recesses in these locations, and instead openings are cut above the level of the reinforcing members as a subsequent, time consuming manufacturing step. The arrangement of the invention is thus advantageous in that manufacture of the cover is simplified.

As the end sections 24 are not reinforced, it is desirable that in use these sections of the cover overlie the ground surface rather than being located above the trench, the trench preferably being spanned by the reinforced section 22. To assist in ensuring that this is the case, the upper surface 16 is preferably provided with markings identifying which parts of the cover are permitted to safely extend over the trench, in use.

Figure 7A:
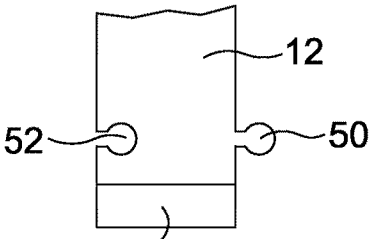
Figure 7B:
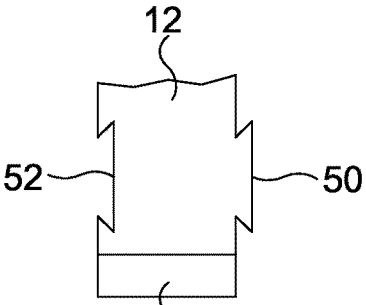
Figure 7C:
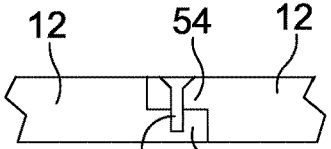
Figure 7D:
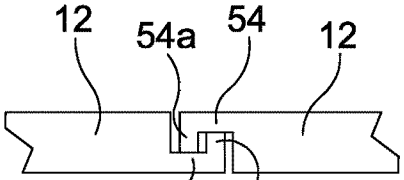
Figure 7E:
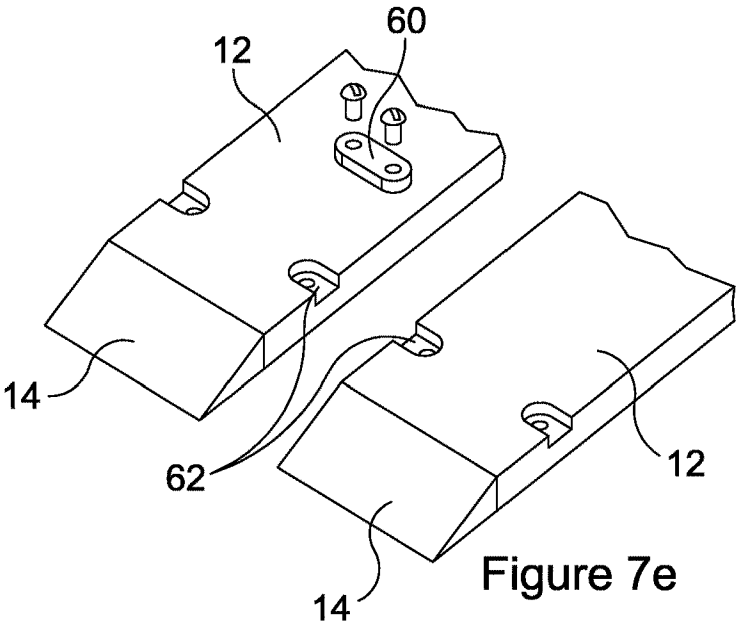

Although the arrangement described hereinbefore includes a specific type of link means, it will be appreciated that the invention is not restricted in this regard and that a number of other designs of link means may be employed without departing from the scope of the invention. By way of example, FIGS. 7*a* to 7*h* illustrate several alternative forms of link means. In the arrangements of FIGS. 7*a* and 7*b*, the link means take the form of projections 50 receivable within correspondingly shaped re-entrant recesses 52, the projections 50 and recesses 52 being located at the end sections 24. FIG. 7*c* illustrates an arrangement in which, along one side of the cover is formed a lip 54 which can rest upon a ledge 56 projecting from the adjacent cover, bolts 58 or other fasteners being used to secure the lip 54 to the ledge 56. The lips 54 and ledges 56 are located at the end sections 24. FIG. 7*d* illustrates an alternative configuration in which the lips 54 and ledges 56 includes side walls 54*a*, 56*a* which interact to resist separation of the covers. FIG. 7*e* illustrates an arrangement in which the link arrangement takes the form of connector plates 60 which can be bolted to the covers, recesses 62 being formed in the end sections 24 to accommodate the connector plates 60.

Figure 7G:
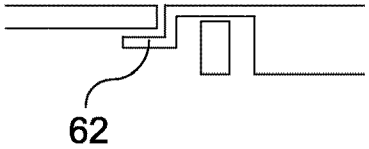
Figure 7F:
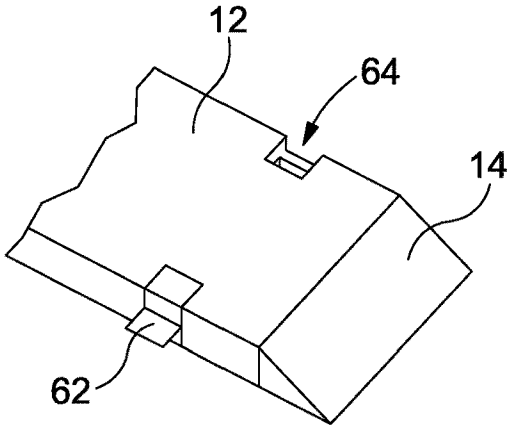
Figure 7H:
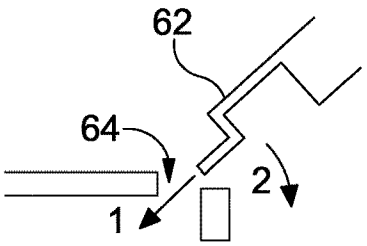

FIGS. 7*f* to 7*h* illustrate an arrangement that, in many respects, is similar to that of FIGS. 1 to 6 but in which the connection plate 62 is located to the top of the cover and is fitted through a slot 64 formed in the end section 24 of the cover. The plate 62 is of stepped form rather than being of angled form. FIG. 7*f* illustrates part of the cover, FIG. 7*g* illustrating two covers linked to one another, and FIG. 7*h* illustrating the method used to link the covers to one another.

It will be appreciated that the options shown in FIGS. 7*a* to 7*h* represent examples of alternative link means, and that other arrangements are possible without departing from the scope of the invention.

Whilst a specific embodiment of the invention is described herein, it will be appreciated that a wide range of modifications and alterations may be made thereto without departing from the scope of the invention as defined by the appended claims.

The invention claimed is:

1. A cover comprising main section provided with link means to allow linking of the cover to an adjacent cover, wherein the main section is shaped to include opposing side walls and defines a reinforced plastics material central region in which elongate reinforcement members are provided extending parallel with the side walls and extending within the confines of the side walls, and end regions located to opposite ends of and integrally formed with the central region, the elongate reinforcement members provided within the confines of the side walls stopping short of the end regions, and wherein the link means are provided at the end regions.

2. A cover according to claim 1, wherein flexible end ramps are fitted to the end regions.

3. A cover according to claim 1, wherein the main section is provided with an opening for receiving a probe associated with a gas sensor.

4. A cover according to claim 1, wherein the link means take the form of projections receivable within correspondingly shaped re-entrant recesses.

5. A cover according to claim 1, wherein the cover is formed with a lip which can rest upon a ledge projecting from the adjacent cover.

6. A cover arrangement to claim 1, wherein the link means comprise connector plates which can be bolted to the covers, recesses being formed in the end regions to accommodate the connector plates.

7. A cover according to claim 1, wherein the side walls are formed with recesses opening to the underside of the cover, the recesses being located in the end regions.

8. A cover according to claim 7, wherein the link means comprise a connector plate fitted to the main section and projecting from one of the recesses thereof, and a connector pin fitted to the main section adjacent another of the recesses thereof.

9. A cover according to claim 8, wherein the underside of the recess with which the connector pin is associated is closed by a cover plate, the recess and cover plate together defining an opening into which the connector plate of the adjacent cover is fitted for cooperation with the connector pin.

10. A cover according to claim 8, wherein the connector plate is arranged such that a projecting part thereof is angled upwardly, in use.

11. A cover according to claim 10, wherein the connector plate includes a mounting part secured, in use, to the main section, and an upwardly angled part in which an opening for cooperation with the connector pin is formed.

12. A cover according to claim 1, wherein the cover further comprises additional reinforcement members, the reinforcement members and additional reinforcement members together forming a grid-like arrangement.

13. A cover according to claim 12, wherein the main section defines a series of downwardly depending ribs, the reinforcement members and additional reinforcement members being located within respective ones of the ribs.

14. A cover according to claim 1, wherein a retainer arrangement is provided to resist longitudinal movement of the cover, in use.

15. A cover according to claim 14, wherein the retainer arrangement comprises a housing with which a plurality of moveable pins are associated, the pins being movable under the action of gravity between raised and lowered positions, the pins projecting from the underside of the main section when in their lowered positions.

16. A cover according to claim 15, wherein the main section is formed with mounting formations to allow the housing to be secured thereto such that the housing extends in a substantially horizontal orientation, in use.

* * * * *